US006021577A

United States Patent [19]

Shiells et al.

[11] Patent Number: 6,021,577

[45] Date of Patent: Feb. 8, 2000

[54] BOREHOLE SURVEYING

[75] Inventors: Gordon Malcolm Shiells, Houston, Tex.; David John Kerridge, Edinburgh, United Kingdom

[73] Assignee: Baroid Technology, Inc., Houston, Tex.

[21] Appl. No.: 09/043,338

[22] PCT Filed: Sep. 10, 1996

[86] PCT No.: PCT/GB96/02236

§ 371 Date: Mar. 16, 1998

§ 102(e) Date: Mar. 16, 1998

[87] PCT Pub. No.: WO97/10413

PCT Pub. Date: Mar. 20, 1997

[30] Foreign Application Priority Data

Sep. 16, 1995 [GB] United Kingdom ..... 9518990

[51] Int. Cl.[7] ..... E21B 47/022; E21B 7/06

[52] U.S. Cl. ..... 33/304; 33/302; 175/45

[58] Field of Search ..... 33/304, 302, 303, 33/310, 313; 175/45, 61

[56] References Cited

U.S. PATENT DOCUMENTS

| | | | |
|---|---|---|---|
| 4,361,192 | 11/1982 | Trowsdale | 175/45 |
| 4,682,421 | 7/1987 | Van Dongen et al. | 33/304 |
| 4,761,889 | 8/1988 | Cobern et al. | 33/302 |
| 4,956,921 | 9/1990 | Coles | 33/302 |
| 5,103,920 | 4/1992 | Patton | 175/45 |
| 5,155,916 | 10/1992 | Engebretson | 33/302 |
| 5,435,069 | 7/1995 | Nicholson | 33/304 |
| 5,452,518 | 9/1995 | Dipersio | 33/304 |
| 5,469,736 | 11/1995 | Moake | 33/302 |
| 5,787,997 | 8/1998 | Hartmann | 175/45 |

FOREIGN PATENT DOCUMENTS

| | | |
|---|---|---|
| 0384537 A1 | 2/1990 | European Pat. Off. . |
| 1578053 | 10/1980 | United Kingdom . |
| 2158587 | 11/1985 | United Kingdom . |
| 2185580 | 7/1987 | United Kingdom . |
| 2251078 | 6/1992 | United Kingdom . |

*Primary Examiner*—Christopher W. Fulton
*Assistant Examiner*—Quyen Doan
*Attorney, Agent, or Firm*—Browning Bushman

[57] ABSTRACT

A borehole survey is conducted at a drilling site S by a so-called Interpolated In-Field Referencing (IIFR) method in which: (a) absolute local geomagnetic field data is obtained by spot measurement of the earth's magnetic field at a local measurement site R which is sufficiently close to the drilling site S that the measurement data is indicative of the earth's magnetic field at the drilling site S but which is sufficiently remote from the drilling site S that the measurement data is unaffected by magnetic interference from the drilling site and other man-made installations; (b) time-varying geomagnetic field data is obtained by combining the absolute local geomagnetic field data with data indicative of variation of the geomagnetic field with respect to time obtained by monitoring variation of the earth's magnetic field with respect to time at a remote monitoring site P1, P2; (c) downhole magnetic field data is obtained by monitoring by means of a surveying instrument the magnetic field in the vicinity of the borehole at a series of locations along the borehole; and (d) the orientation of the borehole is determined from the downhole magnetic field data and the time-varying geomagnetic field data. Such a survey method takes into account short-term variations in the geomagnetic field caused by electrical currents in the ionosphere and is therefore more accurate than known survey methods.

9 Claims, 1 Drawing Sheet

FIG 1
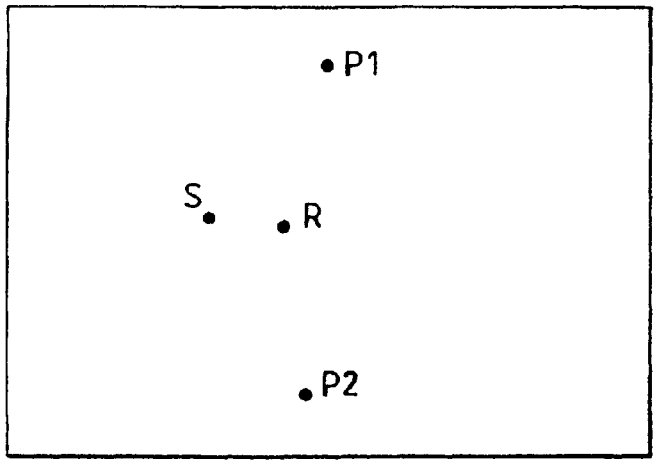
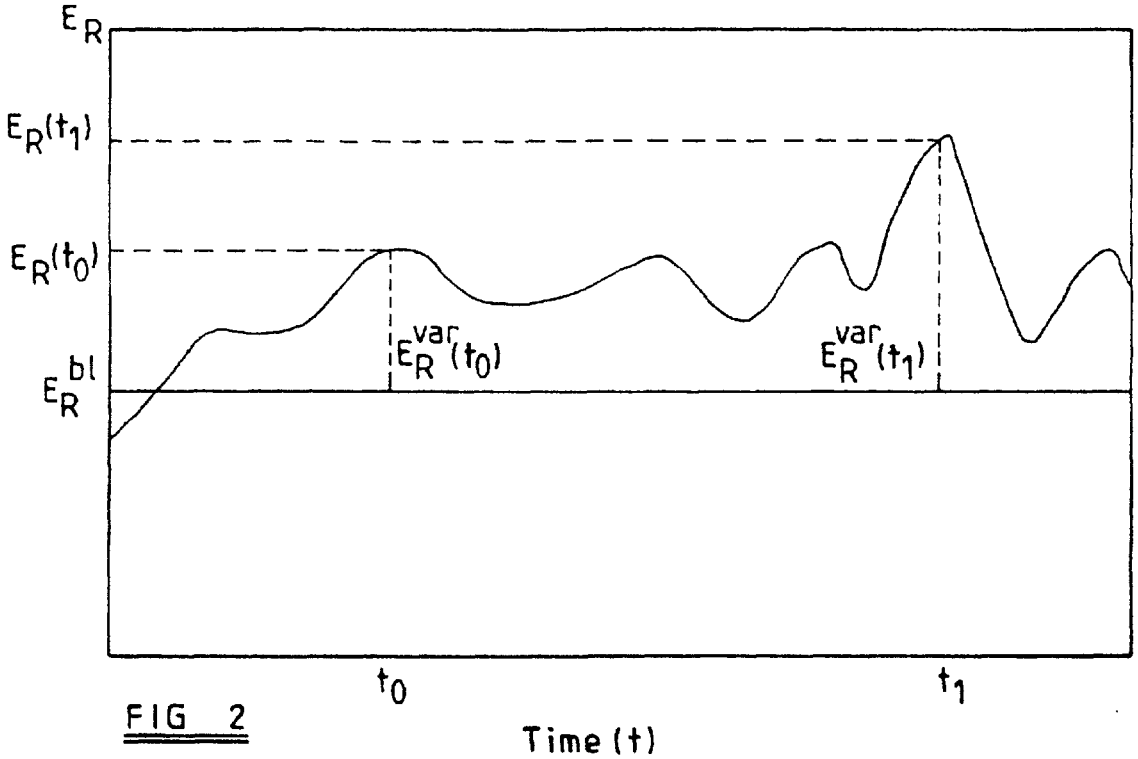
FIG 2

BOREHOLE SURVEYING

This invention relates to the surveying of boreholes at drilling sites.

It is well known to survey boreholes which are not cased with a steel lining by making measurements at a series of downhole locations utilising a survey instrument incorporating two or three mutually orthogonal fluxgates and two or three mutually orthogonal accelerometers disposed in a non-magnetic drill collar so as to determine a series of parameters, such as the inclination angle and the azimuth angle, indicative of the orientation at a series of locations along the borehole.

British Patent Specification No. 1578053 describes a survey method in which a corrected azimuth angle measurement, corrected to compensate for the effects of perturbing magnetic fields associated with magnetised sections of the drill string both above and below the survey instrument, is obtained as a function of the horizontal and vertical components of the earth's magnetic field, as ascertained from look-up tables for example, the downhole magnetic field as measured by the instrument, and measured values of the inclination angle and the azimuth angle relative to the apparent magnetic North direction at the location of the instrument. British Patent Specifications Nos. 2158587 and 2185580 describe other, related survey methods.

All these survey methods rely on measurement of the orientation of the borehole relative to the geomagnetic field so that the borehole orientation can then be referred to the geographical coordinate system from knowledge of the orientation of the geomagnetic field relative to true North and the horizontal plane. Calibration of the survey instrument also relies on knowledge of the intensity of the geomagnetic field. Geomagnetic field data indicative of the direction and intensity of the geomagnetic field is usually obtained from look-up tables which provide such parameters for the local area based on a mathematical model of the global geomagnetic field. However such survey methods ignore the effects of short-term variations in the geomagnetic field caused by electrical currents in the ionosphere. The effect of such short-term variations is to provide significant errors in the measurement data which severely limit the accuracy of the survey results.

Furthermore it is known to obtain local geomagnetic field data by direct measurement in the vicinity of the drilling site. In theory, if sufficient measurements of the local geomagnetic field are taken, errors due to short-term variations in the geomagnetic field can be eliminated. However, in practice, it is not feasible to measure the geomagnetic field and its variation at the drilling site because of the magnetic interference produced by the drilling hardware.

It is an object of the invention to provide a borehole surveying method which overcomes the problems of such prior methods.

According to the present invention there is provided a method of surveying a borehole at a drilling site, which method comprises:

(a) obtaining local geomagnetic field data by spot measurement of the earth's magnetic field at a local measurement site which is sufficiently close to the drilling site that the measurement data is indicative of the earth's magnetic field at the drilling site but which is sufficiently remote from the drilling site that the measurement data is unaffected by magnetic interference from the drilling site and other man-made installations;

(b) obtaining time-varying geomagnetic field data by combining said local geomagnetic field data with data indicative of variation of the geomagnetic field with respect to time obtained by monitoring variation of the earth's magnetic field with respect to time at a remote monitoring site (which will usually be at a substantially greater distance from the drilling site than the local measurement site);

(c) obtaining downhole magnetic field data by monitoring by means of a surveying instrument the magnetic field in the vicinity of the borehole at a series of locations along the borehole; and (d) determining the orientation of the borehole from said downhole magnetic field data and said time-varying geomagnetic field data.

Such a method, which may be referred to as Interpolated In-Field Referencing (IIFR), relies on spot measurement of the values of the geomagnetic field, such as the intensity and direction of the geomagnetic field for example, at a local measurement site near to the drilling site (say within a few tens of kilometres) which is substantially free from man-made magnetic fields. The spot measurement is combined with substantially continuous data from one or more remote monitoring sites recording variation of the geomagnetic field with respect to time, which is indicative of the relative variation of the field intensity and direction, to give an indication of the absolute field intensity and direction at the drilling site at any instant of time.

Such a survey method takes into account short-term variations in the geomagnetic field caused by electrical currents in the ionosphere, and thus provides survey results of substantially greater accuracy than has previously been possible.

In order that the invention may be more fully understood, a preferred embodiment of the invention will now be described, by way of example, with reference to the accompanying drawing, in which:

FIG. 1 is a diagram illustrating the relative locations of the drilling site and the associated measurement sites; and FIG. 2 is a graph showing variation of a geomagnetic parameter as a function of time at the drilling site.

Before the surveying method in accordance with the invention, so called Interpolated In-Field Referencing (IIFR), is described in detail, a brief explanation will be given of the theoretical basis of this method.

The geomagnetic field at any point in space and time may be represented fully by three components in a geographical Cartesian coordinate system:

X—the geographic (true) North component;

Y—the geographic East component; and

Z—the vertical component (reckoned positive downwards).

Four other quantities often used in describing the geomagnetic field are defined by the following relations:

$D=\tan^{-1}(Y/X)$—the declination (or magnetic variation);

$H=(X^2+Y^2)^{0.5}$—the horizontal intensity;

$I=\tan^{-1}(Z/H)$—the inclination (or dip); and $F=(X^2+Y^2+Z^2)^{0.5}$—the total intensity.

The declination is the angle between true North and the horizontal projection of the geomagnetic field vector. The inclination is the angle between the geomagnetic field vector and its horizontal projection. The seven quantities defined above are referred to as "geomagnetic elements". In the description which follows the symbol E will be used to denote any one of these elements.

If a geomagnetic element E is measured continuously, it is observed to vary with a quasi-regular daily variation. Sometimes there is superimposed on such variation irregular variations having timescales of minutes to hours which can be of much greater amplitude than the regular variation. During a geomagnetically disturbed period irregular variations may persist for several days. The quasi-regular variation is caused by tidal and diurnal heating effects in the ionosphere, whereas the irregular variations are caused by the interaction of the earth's magnetosphere with the solar wind.

There are two classes of measurement of the geomagnetic field, namely:

1) Absolute measurement—this is a spot measurement of an element of the geomagnetic field made in such a way that instrument error and alignment error are accounted for, and in this sense is a precise measurement (within the level of accuracy permitted by the particular measurement method). Whilst such absolute measurement would normally imply achievement of a high, but not necessarily well-defined, standard of accuracy, it should be appreciated that such absolute measurement can be effected by an automatic unit, which is particularly appropriate when the measurement is to be effected offshore, in which case a well-defined measurement accuracy would be achieved, although such measurement accuracy would not be of the standard expected at a magnetic observatory. In so far as instrument and alignment errors are accounted for, the measurements may eliminate or correct for such errors, or may simply incorporate an attributed uncertainty estimate taking such errors into account.

2) Variometer measurement—such measurements are made by instruments (variometers) which measure accurately the changes in a geomagnetic element over short time scales. They may be subject to long-term drift as the properties or the alignment of the variometer change with time. Variometers can supply continuous (in the sense of regularly sampled) records of geomagnetic field changes.

It is a known practice at a standard permanent magnetic observatory to combine the variometer output at the time of an absolute measurement with the absolute measurement value to enable a baseline for the variometer to be determined. Thereafter, combination of the baseline with the variometer output enables a continuous absolute measurement record to be maintained. As indicated above, the variometer may drift with time, and so the baseline should be determined on a weekly or monthly basis to adjust for this drift and maintain accuracy of the absolute record.

The technique of IIFR has been developed to achieve the equivalent of the combination of absolute and variometer measurements at a drilling site, without having to operate a variometer at the site, and with only a minimum of one series of absolute measurements having to be made at a nearby location. This may be necessary because:

1) it may not be possible to make an absolute measurement of the geomagnetic field at the drilling site due to unwanted permanent man-made magnetic fields; and
2) it may not be feasible to install a variometer at or close to the drilling site due to the likelihood of varying man-made magnetic fields, or because of logistical difficulties.

There are two requirements for operating IIFR at a drilling site:

1) an absolute measurement should be made at a location close to the drilling site (generally within a few tens of kilometres); and
2) variometer records which have been corrected for baseline drift should be available from one or more remote monitoring sites (which may be several hundred kilometres or more distant).

FIG. 1 illustrates schematically a typical layout for IIFR. S is a drilling site at which an accurate estimate of an element E is required at particular instant $t_1$, the estimate being referred to as $E_S(t_1)$. It is unlikely that an accurate measurement of E can be obtained by direct measurement because of the interference caused by the steel superstructure of the drilling rig. If an accurate measurement of E is available at a nearby reference station R, this can be translated to S by the addition of a correction $\Delta E_{RS}$ known as the site difference. This is the difference in value of E between S and R which arises from two sources, namely the variation of the main part of the geomagnetic field with latitude and longitude, and the effects of local crustal magnetisation. $\Delta E_{RS}$ is generally constant over time and can be estimated from a model of the main geomagnetic field, such as the British Geological Survey Global Geomagnetic Model (BGGM), and from local surveys of crustal magnetisation if available. It is desirable for R to be as close to S as possible (but outside the range of magnetic interference from man-made sources). Then $$E_S(t_1)=E_R(t_1)+\Delta E_{RS}$$

The problem is then one of specifying $E_R$ accurately at $t_1$. A method (described below) is used to estimate variations in $E_R$ as a function of time, referred to as $E_R^{var}(t)$, relative to a baseline value $E_R^{b1}$. (The estimate $E_R^{var}(t)$ may be thought of as being equivalent to the output of a hypothetical variometer positioned at R.) FIG. 2 illustrates the principle of determining and using the baseline value. An absolute measurement of $E_R$ referred to as $E_R(t_0)$ is made at some time. The baseline value is given by $$E_R^{b1}=E_R(t_0)-E_R^{var}(t_0)$$

The baseline value can be thought of as an offset of the variation measurements. It should be nearly constant in time, but may drift slowly if the instruments measuring the variations are subject to drift. In general it will be different from $E_R(t_0)$ because the method for estimating $E_R^{var}(t_0)$ will not normally produce a value of zero at the instant of $t_0$.

Subsequently, the value of $E_R$ at any other time, for instance at $t_1$, is given by $$E_R(t_1)=E_R^{var}(t_1)+E_R^{b1}$$

In the ideal case $E_R^{var}(t_1)$ would be measured by placing a variometer at R to measure it. However this will not generally be practicable, particularly for offshore drilling sites. Instead $E_R^{var}(t_1)$ may be estimated from a suitable transformation of variation measurements made at one or more permanent remote monitoring sites (P1, P2 in FIG. 1) referred to as $E_{Pn}^{var}$ where the subscript Pn identifies the monitoring site. The variation measurements from each monitoring site should be corrected for instrument drift, or otherwise this drift will be transformed into the estimate of $E_R^{var}(t_1)$. If more than one remote monitoring site is used, it is preferable that the monitoring sites span the drilling site S in latitude and longitude. The general form of the transformation for N monitoring sites may be presented as:

$$E_R^{\mathrm{var}}(t_1)=\sum_{n-1}^{N}[w_n\cdot\Lambda(E_{pn}^{\mathrm{var}})\cdot\Phi(\lambda_{pn}-\lambda_R)+\mu_n\cdot\Pi(E_{pn}^{\mathrm{var}})]$$

The first term on the right hand side is to account for the regular daily variation which occurs with a fundamental period of 24 hours and is dependent on local time, $\Lambda(E_{Pn}^{var})$ represents a low pass filter, and $\Phi(\lambda_{Pn}-\lambda_R)$ represents a function (which may actually be incorporated in $\Lambda$) which introduces a phase shift as a function of the longitude ($\lambda$) difference between Pn and R. The second summation term on the right hand side, in which $\Pi(E_{Pn}^{var})$ represents a high pass filter, transforms the irregular variations measured at the remote sites which typically occur on time scales of a few hours or less. In each summation term, w and $\mu$ represent weight functions for combining the filtered variations from the N permanent monitoring sites. The precise forms of $\Lambda$ and $\Pi$, and the choice of the weights w and $\mu$, depend on the region of the Earth in which the measurements are made, and on the geometry of the stations, and so are not specified further here.

A method of surveying a borehole at the drilling site S in accordance with the invention will now be described utilizing the time-varying IIFR geomagnetic field data $E_S$ obtained by translating the absolute local geomagnetic field data $E_R$ combined with data $E_R^{var}$ indicative of variation of the geomagnetic field with respect to time obtained by mathematical transformation of measurement data from one or more permanent remote monitoring sites, such as one or more magnetic observatories. Usually the time-varying geomagnetic field data supplied by monitoring sites will be in the form of geomagnetic field values of total intensity F, inclination I and declination D taken at regular time intervals of, say, a few seconds. In this manner IIFR geomagnetic field data, such as the total intensity F, the inclination I and the declination D, at the time of the survey may be calculated for the location of the drilling site as explained above.

The required borehole survey data is obtained in the usual manner by means of a survey instrument accommodated within a non-magnetic drill collar within a drill string and comprising three accelerometers arranged to sense components of gravity Gx, Gy, Gz in three mutually orthogonal directions, one of which (the z axis) is coincident with the longitudinal axis of the drill string, and three fluxgates arranged to measure the magnetic field components Bx, By, Bz in the same three mutually orthogonal directions. As the drill string is lowered within the borehole the survey values Gx, Gy, Gz, Bx, By, Bz in the form of proportional voltages are supplied to analogue to digital conversion circuitry, together with time values Ts indicative of the times at regularly spaced intervals at which the sets of survey measurements are taken. The outputs from the analogue to digital conversion circuitry are supplied to a digital computing unit to yield survey values, such as values of the azimuth angle $\psi$ and borehole inclination angle $\theta$ at successive survey stations. Whilst this computing operation may be performed within the survey instrument, it is usually more convenient to store the outputs from the analogue to digital conversion circuitry in a memory section, and to provide the computing unit in the form of a separate piece of apparatus to which the survey instrument is connected after extraction from the borehole for performing the computing operation.

The declination, which is the angular difference between magnetic north and True North, measured by IIFR, may be used in place of the values which are normally obtained from a geomagnetic main field model or from geomagnetic charts in order to compensate for changes in the declination of the magnetic field when converting from the magnetic azimuth angle to the true azimuth angle. Model or chart derived data is known to contain large unpredictable possible errors, and substitution of the IIFR geomagnetic field data results in a substantial reduction in errors and in greatly enhanced survey accuracy performance because of the reduction in the uncertainty of the declination value.

To this end the following series of calculations is carried out in the digital computing unit with the value of the declination D of the IIFR geomagnetic field data at the time of the survey obtained in the manner described above being utilized to calculate the true azimuth angle $\psi_T$ from the magnetic azimuth angle $\psi_M$:

$$Goxy = \sqrt{Gx^2 - Gz^2}$$

Gravity Toolface $\Phi = \tan^{-1}\left(\frac{Gx}{Gy}\right)$

Inclination $\theta = \tan^{-1}\left(\frac{Goxy}{Gz}\right)$

Azimuth $\Psi_M = \tan^{-1}\left(\frac{-(Bx \cdot \sin\Phi + By \cdot \cos\Phi)}{\cos\theta(Bx \cdot \cos\Phi - By \cdot \sin\Phi) + Bz \cdot \sin\theta}\right)$ Azimuth $\Psi_T = \Psi_M + D$ As is well known, the downhole magnetic field at the location of the survey is modified by the effect of the magnetised portions of the drill string both above and below the non-magnetic drill collar within which the survey instrument is accommodated, and this has the effect of introducing an error vector component in the direction of the drill string, that is along the z axis. Drill string magnetic interference correction methods are known which are capable of enhancing the accuracy of such surveys. However the accuracy performance of such correction methods is highly sensitive to errors in values of geomagnetic input parameters required in such methods. Values obtained from models of the geomagnetic field are known to contain large possible errors, and this can give rise to considerable uncertainty in several of the magnetic parameters obtained by such correction methods which can considerably affect the quality of the survey.

In order to eliminate the effect of such magnetic interference, a series of calculations may be carried out without using the measured Bz value in order to obtain the corrected azimuth angle. These calculations make use of the IIFR geomagnetic field data values of the horizontal intensity H and the vertical component Z at the time of the survey, these values being obtained by calculation from the values of the total intensity F and the inclination I obtained by combining the absolute local magnetic field data with data indicative of variation of the geomagnetic field with respect to time. The corrected azimuth angle is calculated using an iteration loop starting with initial value of the azimuth angle $\psi\mathbf{0}$. Starting with this value, successive values of $Bz_0$ and $\psi n$ are calculated utilising the expressions given.

Bx=Bx.cos $\Phi$−By.sin $\Phi$

By=Bx.sin $\Phi$+By.cos $\Phi$

Initial Adjusted Azimuth $$\Psi_o = \tan^{-1}\left(\frac{-By' \cdot \cos\theta}{Bx' + Z \cdot \sin\theta}\right)$$

$Bz_0$=H.cos $\Psi_{n-1}$.sin 0+Z.cos $\theta$

Adjusted Azimuth $$\Psi_n = \tan^{-1}\left(\frac{-By'}{Bx' \cdot \cos\theta + Bz_0 \cdot \sin\theta}\right)$$

The calculation is iterated until the value of $\Psi$ has converged, i.e. when $|\Psi_n - \Psi_{n-1}| < 0.000001$ The value of the azimuth angle thus obtained corrected for the effect of axial drill string magnetisation may be provided as a second solution (Aza) in the survey results in addition to the first solution (AZ) provided by the first described method. Such a method greatly reduces errors in the values of the key magnetic parameters, thus enhancing the performance of the interference correction routines and improving survey quality.

The application of IIFR to magnetic survey data enables significant reductions in certain error values of magnetic survey instrument performance models, such as directional reference error and drill string interference as indicated above. This results in a reduction in calculated borehole positional uncertainty, and in many cases this removes the necessity to perform additional costly survey runs with gyroscopic devices or other more accurate survey systems. This results in a reduction in drilling costs, and an increase in drilling efficiency and safety.

Furthermore the IIFR technique enables downhole measured magnetic parameters to be compared with accurate magnetic measurements made in the vicinity of the drilling site and within the same time reference frame. The absence of significant differences between the downhole measured magnetic parameters and the IIFR measurements may be sufficient to validate the survey data without recourse to additional more accurate survey systems. Conversely significant differences between these values are indicative either of external effects or of errors in the survey tool measuring devices sufficient to invalidate the survey data.

Furthermore the IIFR geomagnetic field data can be used to restrict directional errors in real time by alerting the drilling operator to the existence of significant disturbances in the geomagnetic field. This can be done by setting limits on how much the geomagnetic field can change before all survey points need to be recalculated.

We claim:

1. A method of surveying a borehole at a drilling site comprising:

(a) obtaining local geomagnetic field data by spot measurement of the earth's magnetic field at a local measurement site which is sufficiently close to the drilling site that the measurement data is indicative of the earth's magnetic field at the drilling site but which is sufficiently remote from the drilling site that the measurement data is unaffected by magnetic interference from the drilling site and other man-made installations;

(b) obtaining time-varying geomagnetic field data by combining said local geomagnetic field data with data indicative of variation of the geomagnetic field with respect to time obtained by monitoring variation of the earth's magnetic field with respect to time at a remote monitoring site;

(c) obtaining downhole magnetic field data by monitoring by means of a surveying instrument the magnetic field in the vicinity of the borehole at a series of locations along the borehole; and (d) determining the orientation of the borehole from said downhole magnetic field data and said time-varying geomagnetic field data.

2. A method according to claim 1, wherein said time-varying geomagnetic field data is obtained by transforming said monitored data indicative of variation of the geomagnetic field with respect to time in order to take account of the longitude difference between the remote monitoring site and the local measurement site so as to obtain transformed time-varying data for combining with said absolute local geomagnetic field data.

3. A method according to claim 2, wherein the transformed time-varying data $E_R^{var}(t_1)$ at time $t_1$ is obtained from the data $E_{Pn}^{var}$ from N remote monitoring sites using the general expression:

$$E_R^{\mathrm{var}}(t_1) = \sum_{n-1}^{N} [w_n \cdot \Lambda(E_{pn}^{\mathrm{var}}) \cdot \Phi(\lambda_{pn} - \lambda_R) + \mu_n \cdot \Pi(E_{pn}^{\mathrm{var}})]$$

where the first term on the right hand side is to account for the regular daily variation which occurs with a fundamental period of 24 hours and is dependent on local time, $\Lambda(E_{Pn}^{var})$ represents a low pass filter, $\Phi(\lambda_{Pn}-\lambda_R)$ represents a function (which may actually be incorporated in $\Lambda$) which introduces a phase shift as a function of the longitude ($\lambda$) difference between Pn and R, the second term on the right hand side, in which $\Pi(E_{Pn}^{var})$ represents a high pass filter, is to account for the irregular variations which typically occur on time scales of a few hours or less, and w and $\mu$ represent weight functions for combining the filtered variations from the N remote monitoring sites.

4. A method according to claim 1, wherein, in determining the orientation of the borehole from said downhole magnetic field data, a geomagnetic field value is used which is obtained by adding to said time-varying geomagnetic field data a site difference correction value which is indicative of the fact that the local measurement site is located at a distance from the drilling site and which is substantially constant with respect to time.

5. A method claim 1, wherein the step of determining the orientation of the borehole comprises determining the true azimuth angle of the borehole with respect to the earth's magnetic field from the magnetic azimuth angle determined from said downhole magnetic field data and from a value indicative of the declination of the geomagnetic field obtained from said time-varying geomagnetic field data.

6. A method claim 1, wherein the step of determining the orientation of the borehole comprises determining an initial value for the azimuth angle of the borehole with respect to the earth's magnetic field from said downhole magnetic field data and a value indicative of the vertical component of the geomagnetic field obtained from said time-varying geomagnetic field data, and carrying out a series of iterations in order to obtain successively more accurate values for the azimuth angle of the borehole.

7. A method according to claim 6, wherein each of the iterations comprises determining a value for the downhole magnetic field component in the direction of the borehole utilizing a previously determined value for the azimuth angle, and determining a further value for the azimuth angle utilizing the previously determined value for the downhole magnetic field component in the direction of the borehole.

8. A method claim 1, wherein said data indicative of variation of the geomagnetic field with respect to time comprises total intensity, declination and inclination values of the geomagnetic field.

9. A system for surveying a borehole at a drilling site comprising:

(a) a surveying instrument for monitoring the magnetic field in the vicinity of the borehole at a series of locations along the borehole in order to obtain downhole magnetic field data;

(b) means for recording local geomagnetic field data obtained by spot measurement of the earth's magnetic field at a local measurement site which is sufficiently close to the drilling site that the measurement data is indicative of the earth's magnetic field at the drilling site but which is sufficiently remote from the drilling site that the measurement data is unaffected by magnetic interference from the drilling site and other man-made installations;

(c) means for determining time-varying geomagnetic field data by combining said local geomagnetic field data with data indicative of variation of the geomagnetic field with respect to time obtained by monitoring variation of the earth's magnetic field with respect to time at a remote monitoring site; and (d) means for determining the orientation of the borehole from said downhole magnetic field data and said time-varying geomagnetic field data.

* * * * *